US005874972A

United States Patent [19]

Suetsugu et al.

[11] Patent Number: 5,874,972

[45] Date of Patent: Feb. 23, 1999

[54] ELECTROSTATIC INK JET RECORD HEAD HAVING A CONTROL ELECTRODE FOR EQUALIZING THE ELECTRIC FIELD OF AN INK CHAMBER AN INK JET RECORDER USING SAME

[75] Inventors: Junichi Suetsugu; Hitoshi Minemoto; Yoshihiro Hagiwara; Ryosuke Uematsu; Kazuo Shima, all of Tokyo, Japan

[73] Assignee: NEC Corporation, Tokyo, Japan

[21] Appl. No.: 747,821

[22] Filed: Nov. 13, 1996

[30] Foreign Application Priority Data

Nov. 14, 1995 [JP] Japan ..... 7-295772

[51] Int. Cl.[6] ..... B41J 2/06

[52] U.S. Cl. ..... 347/55

[58] Field of Search ..... 347/55, 141, 112, 347/151

[56] References Cited

U.S. PATENT DOCUMENTS

| | | | |
|---|---|---|---|
| 5,481,286 | 1/1996 | Kagayama | 347/55 |
| 5,650,809 | 7/1997 | Kitamura | 347/55 |

FOREIGN PATENT DOCUMENTS

| | | | |
|---|---|---|---|
| 9311866 | 6/1993 | Australia . | |
| 56167473 | 12/1981 | Japan | 347/55 |
| 55130408 | 4/1982 | Japan | 347/55 |

OTHER PUBLICATIONS

JP 02 160557 A (Minolta Camera Co. Ltd.), Jun. 20, 1990, Patent Abstracts of Japan, vol. 014, No. 416 (M–1021), Sep. 7, 1990.

JP 58 069062 A (Ricoh KK), Apr. 25, 1983, Patent Abstracts of Japan. vol. 007, No. 163 (M–229), Jul. 16, 1983.

*Primary Examiner*—N. Le
*Assistant Examiner*—C. Dickens
*Attorney, Agent, or Firm*—Sughrue, Mion, Zinn, Macpeak & Seas, PLLC

[57] ABSTRACT

An electrostatic ink jet record head of the present invention includes an ink chamber storing ink consisting of a carrier liquid and charged toner particles dispersed therein. An ejection port communicates the ink chamber to the outside of the head. An ejection electrode is disposed in the ejection port and electrically insulated from the ink. An electrophoresis electrode is positioned at the opposite side to the ejection electrode with respect to the ink chamber and electrically insulated from the ink. A control electrode is provided between the electrophoresis electrode and the ejection electrode and contacts the ink. Also, an electrostatic ink jet recorder of the present invention has, in addition to the head, a counter electrode facing the ejection port with the intermediary of a recording medium, and voltage controller for applying a particular preselected voltage to each of the discharge electrode, electrophoresis electrode, and control electrode. The voltage applied to the electrophoresis electrode is higher than a threshold voltage causing the toner particles to fly by themselves, while the voltage applied to the control electrode is lower than the threshold voltage.

3 Claims, 8 Drawing Sheets

ELECTROSTATIC INK JET RECORD HEAD HAVING A CONTROL ELECTRODE FOR EQUALIZING THE ELECTRIC FIELD OF AN INK CHAMBER AN INK JET RECORDER USING SAME

BACKGROUND OF THE INVENTION

The present invention relates to an electrostatic ink jet record head and an ink jet recorder using the same. More particularly, the present invention is concerned with an electrostatic ink jet record head of the type using ink consisting of a carrier liquid and toner particles dispersed therein, and causing only the toner particles to fly electrostatically so as to print an image on a recording medium, and an ink jet recorder using the same.

Nonimpact recording methods are attracting increasing attention because they produce only a negligible degree of noise ascribable to operation. Particularly, an ink jet recorder which is a specific form of a nonimpact recorder has a simple construction and high-speed recording capability and is operable with plain papers. The ink jet recorder with such advantages has been proposed in various forms in the past. One of conventional ink jet recorders uses ink consisting of a carrier liquid and toner particles dispersed therein. In this type of recorder, a voltage is applied to between a needle-like ejection electrode and a counter electrode facing it with the intermediary of a paper. The resulting electric field causes the toner particles of the ink to fly with an electrostatic force and form a dot on a paper or similar recording medium.

Specifically, the above ink jet recorder has an ejection port in the form of a gap small enough to form an ink meniscus. An ejection electrode is positioned in the ejection port and slightly protrudes to the outside from the end of the port. An electrophoresis electrode surrounds an ink chamber. A counter electrode is connected to ground and positioned on the imaginary extension of the ejection electrode. A paper intervenes between the ejection electrode and the counter electrode. Therefore, in the event of recording, an electric field is formed between the two electrodes. The electric field concentrates on the sharp tip of the ejection electrode and extends toward the paper with high intensity. To effect high-speed recording with the above recorder, it is necessary to replenish the toner particles at a high speed, i.e., to increase the speed of electrophoresis of the toner particles. To increase the speed of electrophoresis speed, it is necessary to apply a great potential difference between the ejection electrode and the electrophoresis electrode. However, because the electrophoresis electrode remains in electrical contact with the ink, even the ink around the ejection electrode has the same potential as the electrophoresis electrode in an equilibrium condition. Therefore, if the high voltage is applied to the electrophoresis electrode excessively, then the potential of the ink around the ejection electrode becomes high enough for the toner particles to fly. As a result, the toner particles fly by themselves even when no drive pulses are applied to the ejection electrode.

To better understand the present invention, a brief reference will be made to a conventional electrostatic ink jet recorder, shown in FIGS. 1–3. Briefly, the recorder uses ink consisting of a carrier liquid and toner particles dispersed therein, and includes a needle-like ejection electrode and counter electrode facing it with the intermediary of a paper or similar recording medium. A voltage is applied to between the ejection electrode and the counter electrode so as to generate an electric field. The toner particles of the ink are caused to fly by the electrostatic force of the electric field forming an image on the paper.

As shown, a head 50 has an ink chamber 52 delimited by a lower plate 63, a side wall 64, and an upper plate 65. A pump, not shown, constantly circulates ink 51 in the chamber 52 via circulation ports 59 and 60. The ink 51 has the above-mentioned composition. An ejection port 54 is formed in a part of the side wall 64 and has a gap small enough to form an ink meniscus Me. An ejection electrode 55 is positioned in the ejection port 54 and slightly protrudes to the outside from the end of the port 54. The surface of the electrode 55 is coated with an insulator to be insulated from the ink 51 thereby. An electrophoresis electrode 58 delimits the other three sides of the ink chamber 52 where the ejection port 54 is absent. The electrode 58 is partly positioned in the chamber 52 and held in contact with the ink 51.

The ejection electrode 55 is connected to a driver, not shown. In the event of recording, a high-voltage pulse of the same polarity as the toner particles is applied to the electrode 55. A high voltage of the same polarity as the toner particles is continuously applied to the electrophoresis electrode 58 from a voltage controller 62. A counter electrode 61 is connected to ground and positioned on the imaginary extension of the electrode 55. A paper P intervenes between the electrodes 55 and 61. Therefore, in the event of recording, an electric field is formed between the electrodes 55 and 61. Because the electrode 55 has a sharp tip, the electric field concentrates on the tip of the electrode 55 and extends toward the paper P with high intensity. The toner particles dispersed in the ink 51 have been charged by zeta potential beforehand, so that they are pulled toward the paper P by a Coulomb's force derived from the above electric field. When the Coulomb's force overcomes the surface potential of the ink 51, the toner particles are caused to fly toward the counter electrode 61 in the form of a drop 53. The drop 53 deposits on the paper P and forms a dot thereon. In this type of recorder, the high-voltage pulse to be applied to the ejection electrode 55 is controllable in accordance with an image to be printed on the paper P.

Just after the flight of the toner particles, i.e. drop 53, the toner content of the ink 51 becomes low in the vicinity of the ejection electrode 55 because only the toner particles are mainly consumed. However, the high-potential continuously applied to the electrophoresis electrode 58 causes the toner particles in the ink 52 to electrophoretically migrate toward the electrode 55 away from the electrode 58. Consequently, only the toner particles are replenished to a portion around the electrode 55. Particularly, because the electrode 55 is electrically insulated from the ink 51, the migration of the charged toner particles toward the electrode 55 ends as soon as the potential distribution in the chamber 52 reaches equilibrium. Therefore, the recordable frequency of the head 50 is determined by the period of time necessary for the toner particles to migrate.

To effect high-speed recording with the above recorder, it is necessary to replenish the toner particles at a high speed, I.e., to increase the speed of electrophoresis of the toner particles. Assume that the amount of charge deposited on the toner particles is q, that the electric field is E, that the ink has a viscosity of $\eta$, and that the toner particles have a diameter of r. Then, an electrophoresis speed $v$ is expressed as:

$$v=qE/6\pi\eta r$$

Because the above factors q, $\eta$ and r are fixed values particular to the ink, E must be increased in order to increase the electrophoresis speed $v$. That is, it is necessary to apply a great potential difference between the discharge electrode 55 and the electrophoresis electrode 58. However, because the electrode 58 remains in contact with the ink 51, even the ink 51 around the electrode 55 has the same potential as the electrode 58 in the above equilibrium condition. Therefore, if the high voltage is applied to the electrode 58 excessively, then the potential of the ink 51 around the electrode 55 becomes high enough for the toner particles to fly. As a result, the toner particles fly by themselves even when no drive pulses are applied to the electrode 55.

SUMMARY OF THE INVENTION

It is therefore an object of the present invention to provide an electrostatic ink jet record head capable of preventing toner particles from flying by themselves due to a high voltage applied to an electrophoresis electrode, and of printing at a high record frequency, and an ink jet recorder using the same.

In accordance with the present invention, an electrostatic ink jet record head includes an ink chamber storing ink consisting of a carrier liquid and charged toner particles dispersed therein. An ejection port communicates the ink chamber to the outside of the record head. An ejection electrode is disposed in the ejection port and electrically insulated from the ink. An electrophoresis electrode is positioned at the opposite side to the ejection electrode with respect to the ink chamber and electrically insulated from the ink. A control electrode is provided between the ejection electrode and the electrophoresis electrode and contacts the ink.

Also, in accodance with the present invention, an electrostatic ink jet recorder includes the record head having the above ink, ejection port, ejection electrode, electrophoresis electrode, and control electrode. A counter electrode faces the ejection port with the intermediary of a recording medium. A voltage controller applies a particular preselected voltage to each of the ejection electrode, electrophoresis electrode, and control electrode. The voltage applied to the electrophoresis electrode is higher than a threshold voltage causing the toner particles to fly by themselves, while the voltage applied to the control electrode is lower than the threshold voltage.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
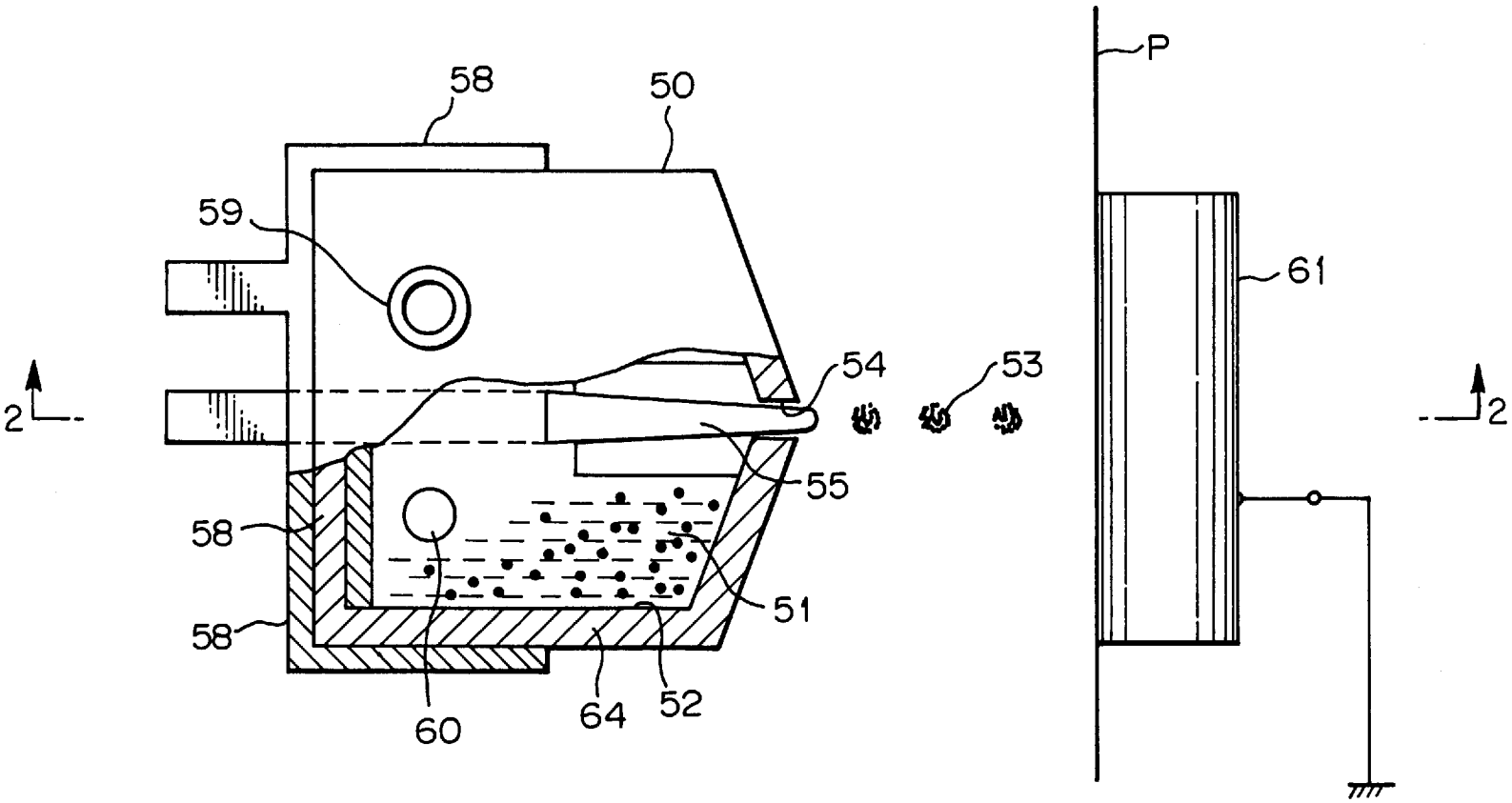
Fig. 1 PRIOR ART
FIG. 1 is a fragmentary plan view showing a conventional electrostatic ink jet recorder.
Figure 2:
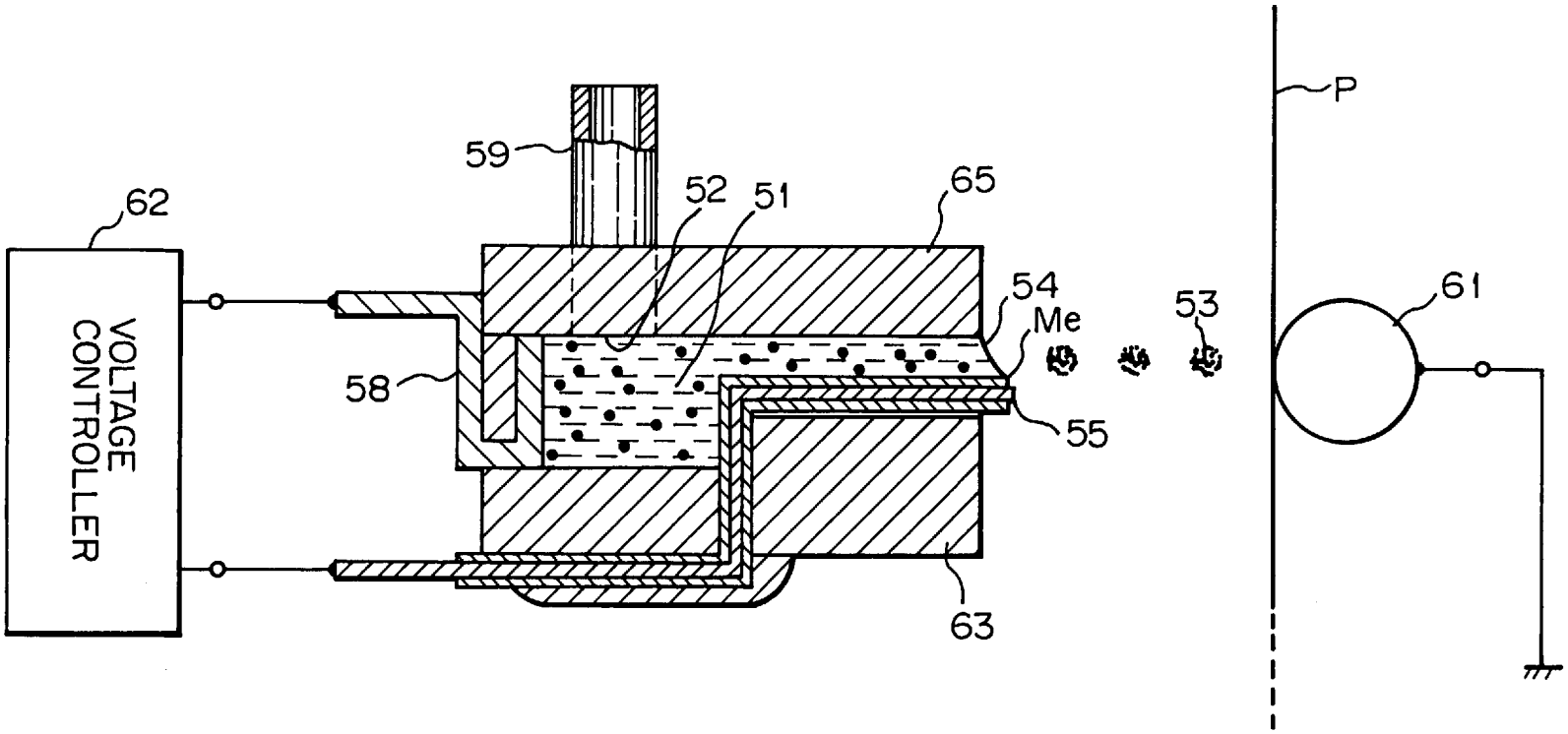
Fig. 2 PRIOR ART
FIG. 2 is a section along line D—D of FIG. 1.
Figure 3:
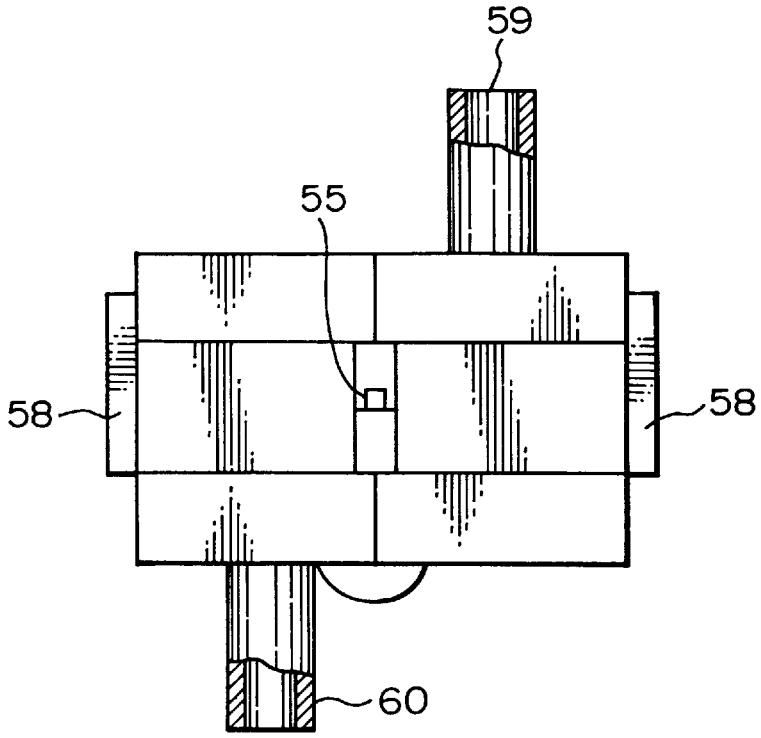
Fig. 3 PRIOR ART
FIG. 3 is a side elevation showing the right side of the recorder shown in FIG. 2.
Figure 4:
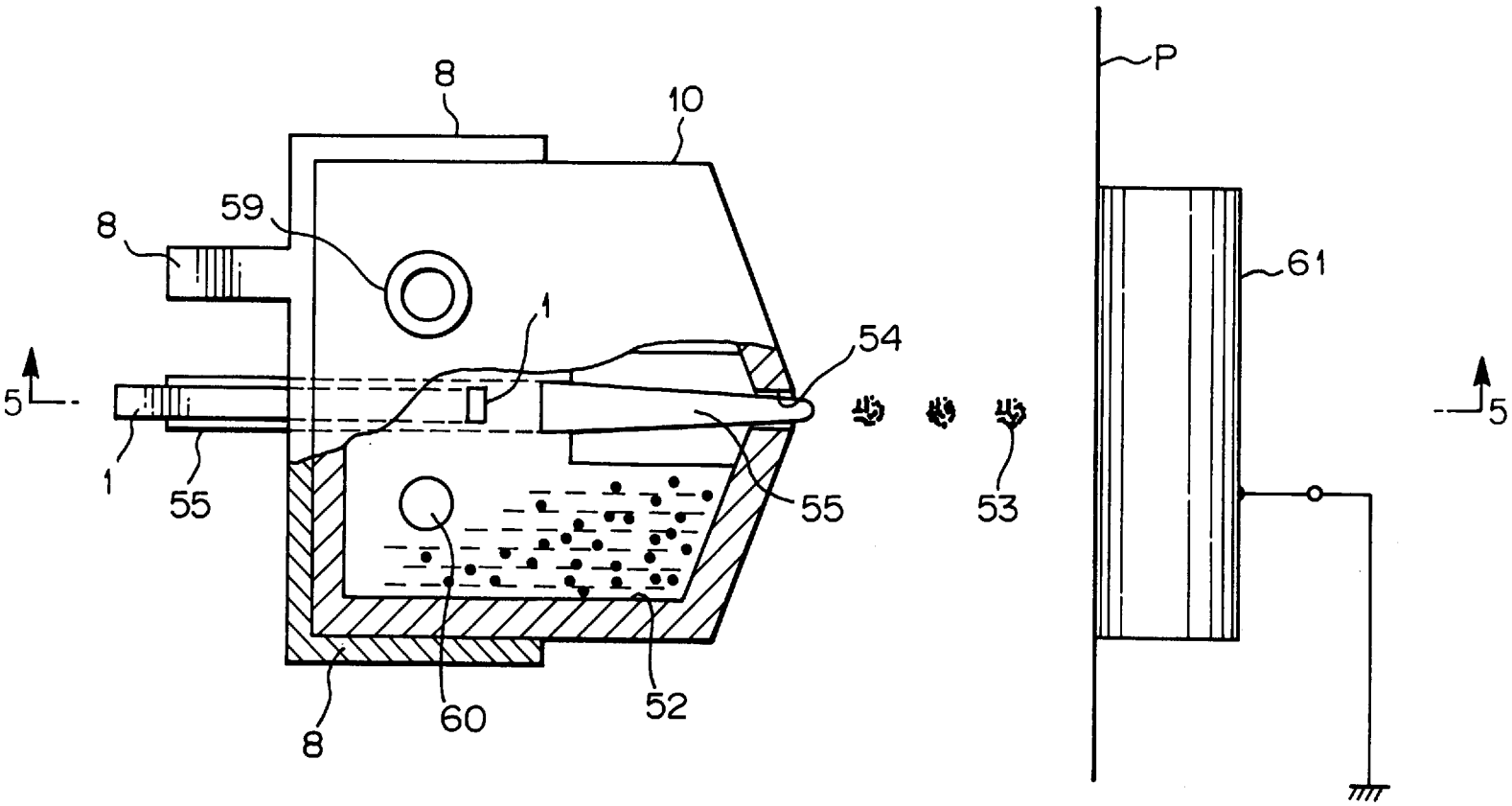
FIG. 4 is a fragmentary plan view showing an electrostatic ink jet recorder embodying the present invention.

Referring to FIGS. 4, 5, 6, 7A, 7B and 7C, an electrostatic ink jet recorder embodying the present invention will be described. In the illustrative embodiment, the same or similar structural elements as the elements of the above conventional recorder are designated by the same reference numerals, and a detailed description thereof will not be made in order to avoid redundancy. As shown, the recorder includes a record head 10 having an ink chamber 52 thereinside. Ink 51 containing charged toner particles dispersed in a carrier liquid is stored in the ink chamber 52. An ejection port 54 communicates the chamber 52 to the outside of the head 10. An ejection electrode 55 is positioned in the ejection port 54 and electrically insulated from the ink 51. An electrophoresis electrode 8 is positioned at the opposite side to the ejection electrode 55 with respect to the chamber 52 and electrically insulated from the ink 51. A control electrode 1 is provided between the two electrodes 8 and 55 and held in contact with the ink 51.

A counter electrode 61 faces the ejection port 54 with the intermediary of a paper or similar recording medium P. A voltage controller 2 applies preselected voltages Vep, Vc and Vej to the electrodes 8, 1 and 55, respectively (see FIGS. 7A–7C). The voltage Vep applied to the electrode 8 is higher than a threshold voltage Vth at which the toner particles fly by themselves as stated earlier. The voltage Vc is lower than the above threshold voltage Vth. When a voltage higher than the threshold voltage Vth is applied to the electrode 8, the toner particles will be ejected from the port 54 even in the absence of a drive pulse. When a voltage lower than the threshold voltage Vth is applied to the electrode 8, the toner particles will not be ejected unless a drive pulse is applied to the electrode 8.

Figure 5:
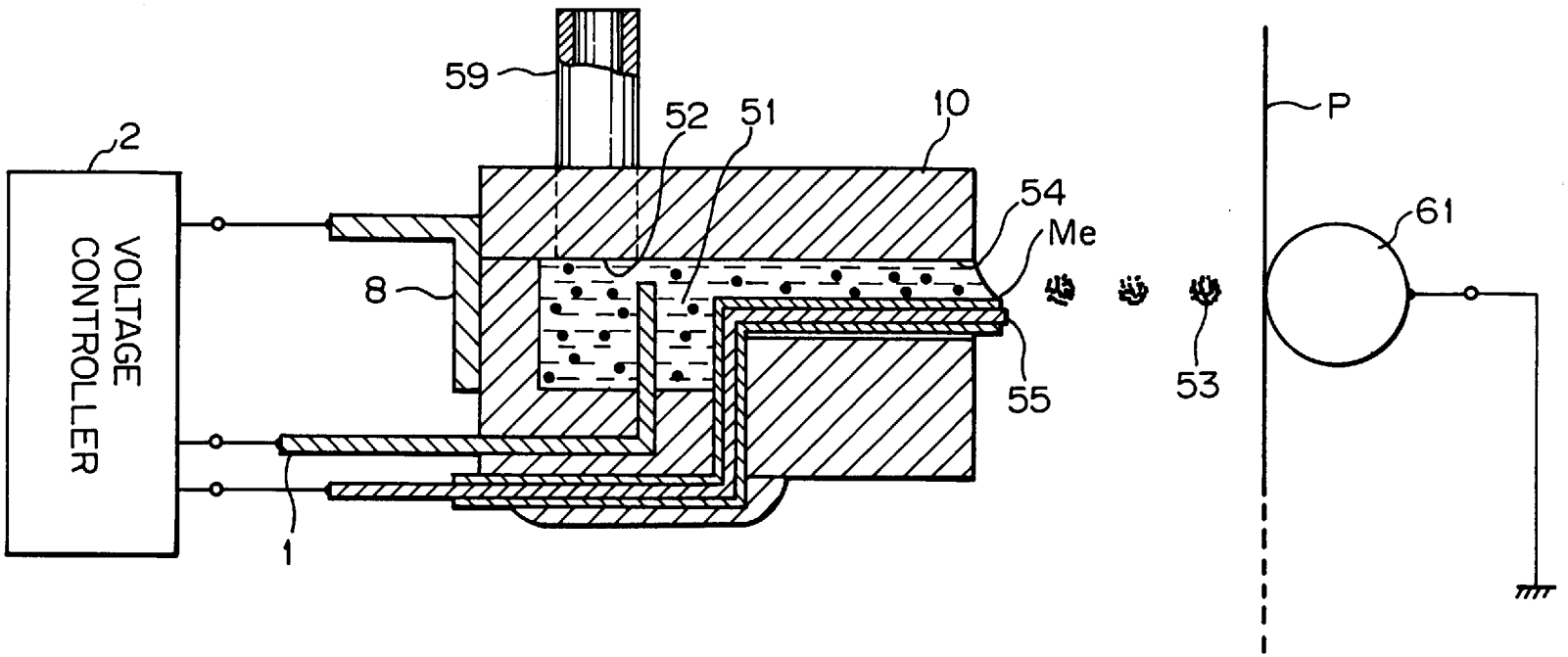
FIG. 5 section along line C—C of FIG. 4.
Figure 6:
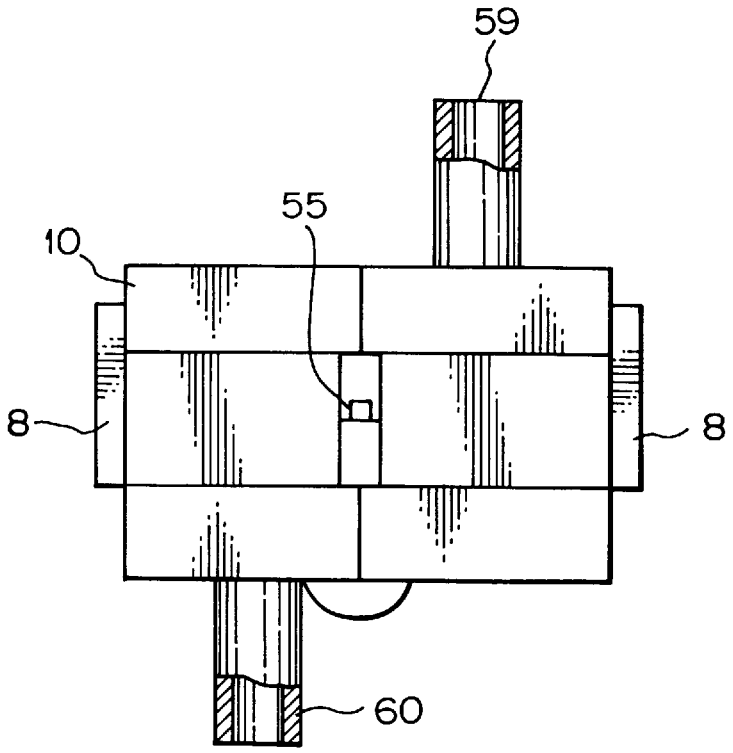
FIG. 6 is a view of the recorder shown in FIG. 4, as seen from the right.

In the illustrative embodiment, the ejection port 54 is implemented as a fine slit. The ejection electrode 55 protrudes about 80 $\mu$m to 100 $\mu$m from the ejection port 54. An ink meniscus Me is formed between the tip of the electrode 55 and the port 54 due to the surface tension of the ink 51. The electrode 55 is a strip formed of Cu (copper), Ni (nickel) or similar conductive metal by electroforming. The strip 55 has a width of about 50 $\mu$m. As shown in FIG. 5, the electrode 55 is bent in the form of a crank and coated with an insulator to be insulated from the ink 51 thereby. While the ink meniscus Me is formed by the port 54 and electrode 55, an exclusive meniscus forming portion may be formed by, e.g., a wire, if desired.

An ink outlet 59 and an ink inlet 60 are formed in the walls of the ink chamber 52. The inlet 59 and outlet 60 are communicated to an ink reservoir by a tubing including a pump, although not shown specifically. When the pump is driven, it produces a vacuum of about 1 cm $H_2O$ while circulating the ink 51 forcibly. In the embodiment, the ink 51 consists of a petroleum-based organic solvent and toner, or thermoplastic colored fine particles, and charge control agent dispersed in the solvent. The toner has been apparently charged to positive polarity by zeta potential beforehand.

The electrophoresis electrode 8 surrounds the ink chamber 52, but it is separate from the ink 51. The control electrode 1, like the ejection electrode 55, is implemented as a strip having a generally L-shaped section, as shown in FIG. 5. The upright portion of the control electrode 1 is located at the intermediate between the electrodes 8 and 55 and held in contact with the ink 51.

Figure 7A:
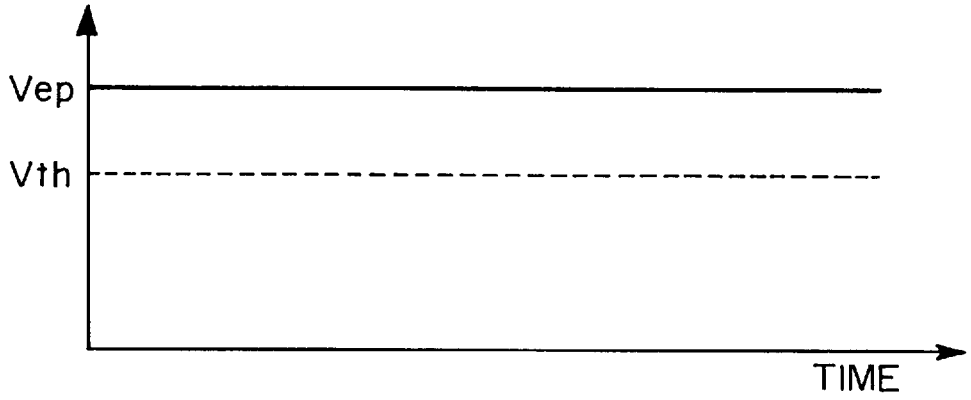
FIGS. 7A, 7B and 7C respectively show voltages applied to an electrophoresis electrode, a control electrode and an ejection electrode included in the embodiment during printing operation.
Figure 7B:
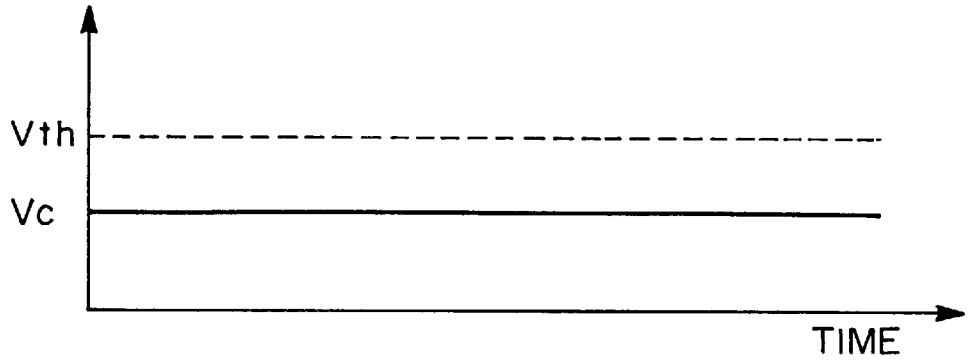
Figure 7C:
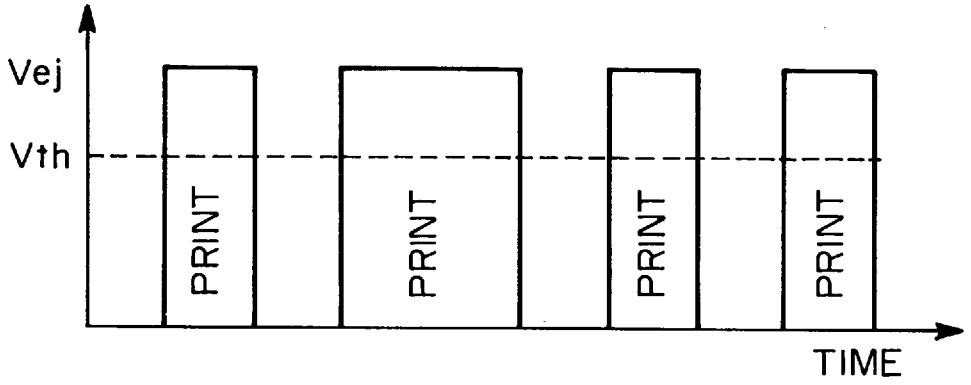

The operation of the illustrative embodiment will be described with reference to FIGS. 7A–7C. When the entire recorder is rendered operative, the voltage controller 2 applies the constant electrophoresis voltage Vep (FIG. 7A) to the electrophoresis electrode 8 insulated from the ink 51. As a result, the charged toner particles migrate toward the ejection electrode 55 due to the difference in potential between the electrodes 8 and 55. To enhance rapid migration of the toner particles, the voltage Vep is selected to be higher than the threshold voltage Vth, as stated earlier. Also, the voltage controller 2 applies the constant control voltage Vc (FIG. 7B) to the control electrode 1 contacting the ink 51. The voltage Vc is lower than the threshold voltage Vth, as also stated earlier.

Because the electrode 8 is insulated from the ink 51, the migration of the toner particles toward the electrode 55 is stabilized when the electric field in the head 10 reaches equilibrium. In the equilibrium condition, the potential of the ink 51 becomes equal to the control potential Vc and is set independently of the electrophoresis potential Vep of the electrode 8. Therefore, even if the voltage applied to the electrode 8 is elevated in order to guarantee the sufficient replenishment of the toner particles to the electrode 55, the toner particles are prevented from flying from the port 54 by themselves. More specifically, despite that the voltage Vep is higher than the threshold voltage Vth, the toner particles can migrate toward the electrode 55 at a high speed while being prevented from flying from the port 54 by themselves.

Assume that the voltage controller 2 feeds a high voltage pulse Vej (FIG. 7C) to the ejection electrode 55 in response to a print command received from a host. Then, the electric field concentrates on the tip portion of the meniscus Me complementary in shape to the tip of the electrode 55. As a result, the charged toner particles in the ink 51 are drawn out from the tip of the meniscus Me and form a drop 53. The drop 53 is caused to fly toward the counter electrode 61, i.e., toward the paper P. The drop 53 formed a dot on the paper P is fixed by heat later.

Just after the flight of the toner particles of positive polarity, the control electrode 1 contacting the ink 1 makes up for the charge lost and thereby maintains the electrical balance. Further, after the flight of the drop 53, the toner particles around the port 54 become short for a moment. However, the potential difference between the electrodes 8, 55 and 61 causes the toner particles to migrate from the chamber 2 toward the port 54 due to electrophoresis. As a result, the port 54 is restored to its initial condition. The above process is repeated thereafter so as to print a desired image on the paper P.

As stated above, in the illustrative embodiment, the electrophoresis electrode 8 and ejection electrode 55 are insulated from the ink 51 while the control electrode 1 is held in contact with the ink 51. The voltage Vep higher than the threshold voltage Vth and the voltage Vc lower than the same are applied to the electrodes 8 and 1, respectively. This successfully enhances the rapid replenishment of the toner by the electrode 8 and thereby realizes high-speed printing.

Figure 8A:
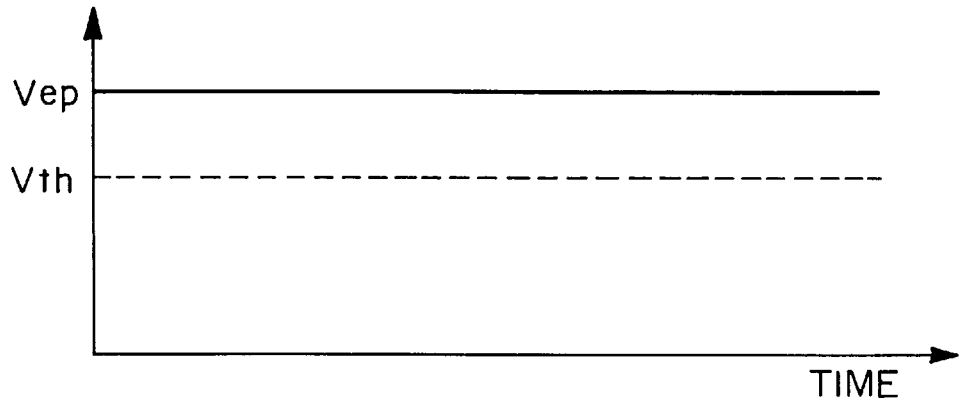
FIGS. 8A, 8B and 8C are representative of an alternative embodiment of the present invention.
Figure 8B:
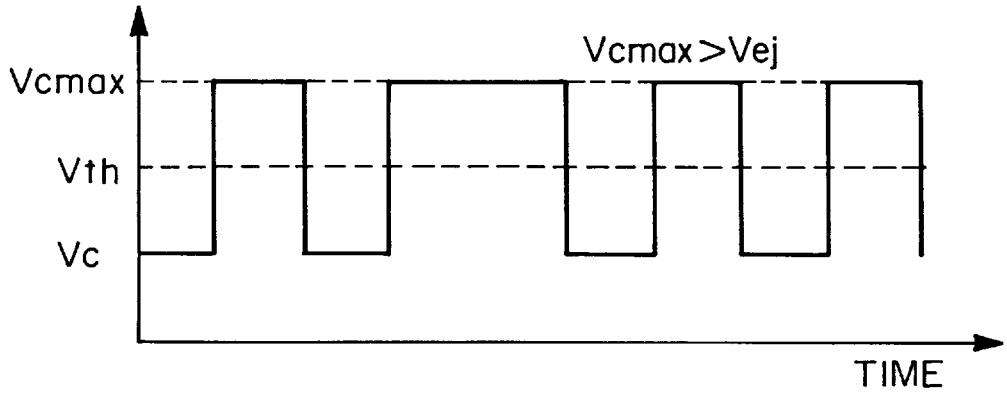
Figure 8C:
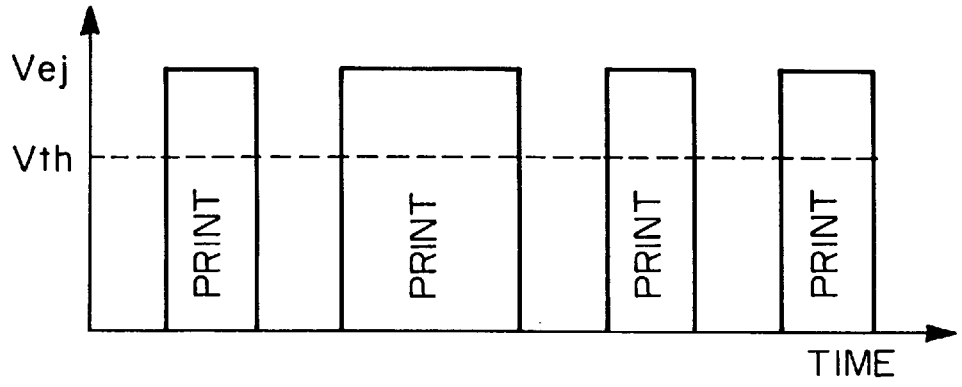

An alternative embodiment of the present invention will be described with reference to FIGS. 8A–8C. This embodiment is practicable with the same physical configuration as the previous embodiment. A difference is that, as shown in FIGS. 8B and 8C, the voltage controller 2 has, in addition to the previously stated function, a function of applying a voltage Vcmax to the control electrode 1 when applying the voltage Vej to the ejection electrode 55. The voltage Vcmax is higher than the voltage Vej.

Specifically, as shown in FIGS. 8B and 8C, the constant control voltage Vc is continuously applied to the control electrode 1 so long as the voltage Vej is not applied to the ejection electrode 55. When the voltage Vej is applied to the electrode 55, the pulse voltage Vcmax higher which is than the threshold voltage Vth is applied to the electrode 1. Therefore, in the equilibrium condition wherein no voltages are applied to the electrode 55, the potential of the ink 51 is the same as the control potential Vc. It follows that the toner particles can migrate toward the electrode 55 rapidly without flying by themselves, despite that the voltage Vep is higher than the threshold voltage Vth. On the other hand, when the pulse voltage Vej is applied to the electrode 55, the control voltage Vcmax becomes higher than the voltage Vej. This obviates a potential well ascribable to the fall of the control voltage below the ejection voltage and thereby further enhances the high-speed toner replenishment.

In summary, it will be seen that the present invention provides an electrostatic ink jet record head promoting rapid toner replenishment to an ejection port by an electrophoresis electrode, i.e., high-speed printing. In addition, the record head is free from a potential well and thereby further enhances rapid toner replenishment. Also, the present invention provides an electrostatic ink jet recorder with the record head having the above various unprecedented advantages.

Various modifications will become possible for those skilled in the art after receiving the teachings of the present disclosure without departing from the scope thereof.

What is claimed is:

1. An electrostatic ink jet record head comprising:

an ink chamber storing ink consisting of a toner carrier having a carrier liquid and charged toner particles dispersed therein;

an ejection port for discharging the ink stored in said ink chamber to an exterior of said record head;

an ejection electrode disposed in said ejection port and electrically insulated from the ink;

an electrophoresis electrode positioned on the exterior of said record head at an opposite side from said ejection electrode and said ejection port and electrically insulated from the ink, wherein a voltage of said electrophoresis electrode causes the charged toner particles to migrate toward said ejection electrode; and a control electrode having one end portion disposed within said ink chamber between said ejection electrode and said electrophoresis electrode and contacting the ink, and having another, opposite end portion extending exteriorly of said record head, wherein said control electrode has a voltage lower than the voltage of said electrophoresis electrode, causing an electric field of the record head to reach equilibrium so that the charged toner particles which migrate toward said ejection electrode do not discharge from said ejection port unintentionally.

2. An electrostatic ink jet recorder comprising:

a record head comprising an ink chamber storing ink consisting of a a toner carrier having carrier liquid and charged toner particles dispersed therein, an ejection port for discharging the ink from said ink chamber to an exterior of said record head, an ejection electrode disposed in said ejection port and electrically insulated from the ink, an electrophoresis electrode positioned on the exterior of said record head at an opposite side from said ejection electrode and said ejection port and electrically insulated from the ink, and a control electrode having one end portion disposed within said ink chamber between said ejection electrode and said electrophoresis electrode and contacting the ink, and having another, opposite end portion extending exteriorly of said record head;

a counter electrode facing said ejection port with a recording medium disposed therebetween; and a voltage controller for applying a separate and particular preselected voltage to each of said ejection electrode, said electrophoresis electrode, and said control electrode, wherein the voltage applied to said electrophoresis electrode is higher than a threshold voltage which causes the toner particles to fly by themselves and migrate toward said ejection electrode, while the voltage applied to said control electrode is lower than said threshold voltage so that the voltage of said control electrode cooperates with the voltage of said electrophoresis electrode to cause an electric field of said ink chamber to reach equilibrium thereby preventing the toner particles from discharging from said election port undesirably.

3. A recorder as claimed in claim 2, wherein when said voltage controller applies a voltage to said election electrode, said voltage controller applies a voltage to said control electrode which is higher than the voltage applied to said ejection electrode in order to enhance replenishment of the toner particles.

* * * * *